United States Patent [19]

Casavant

[11] 4,170,162

[45] Oct. 9, 1979

[54] REFLECTOR AND DRUM

[76] Inventor: A. R. Casavant, Box 1124, Chattanooga, Tenn. 37401

[21] Appl. No.: 861,308

[22] Filed: Dec. 16, 1977

[51] Int. Cl.[2] ..... G10G 7/00; G10D 13/02

[52] U.S. Cl. ..... 84/453; 84/411 R

[58] Field of Search ..... 84/453, 411 R, 415, 84/412, 400, 420, 387; 181/191

[56] References Cited

U.S. PATENT DOCUMENTS

| | | | |
|---|---|---|---|
| 423,060 | 3/1890 | Legault | 84/411 |
| 2,494,783 | 1/1950 | Swihart | 84/453 |
| 2,575,795 | 11/1951 | Chenava | 84/400 |
| 3,016,782 | 1/1962 | Laas | 84/453 |
| 3,099,183 | 7/1963 | Alles | 84/400 |
| 3,603,194 | 9/1971 | North | 84/411 |
| 4,012,983 | 3/1977 | Ploeger | 181/191 |
| 4,037,508 | 7/1977 | Wolford | 84/415 |
| 4,048,895 | 9/1977 | May | 84/411 R |

FOREIGN PATENT DOCUMENTS

| | | | |
|---|---|---|---|
| 374187 | 7/1922 | Fed. Rep. of Germany | 84/400 |

*Primary Examiner*—L. T. Hix
*Assistant Examiner*—S. D. Schreyer

[57] ABSTRACT

This invention consists of an improvement in musical instruments which includes an acoustic mirror for reflecting the sounds produced by the musical instrument in a desired direction or directions.

5 Claims, 9 Drawing Figures

REFLECTOR AND DRUM

BACKGROUND AND OBJECTIVES OF THE INVENTION

Musical instruments that are generally employed in marching bands such as snare drums, baritones, alto horns, euphoniams, tubas, and other instruments generally direct their musical tones in one directon which may or may not be the preferrable direction depending on the formation of the band and the particular tones emanating from the particular instruments. For example, a tuba with an upright bell delivers the greatest volume of sound vertically, above the band. While this may be desirable for certain musical compositions it may be undesirable for others where a more lateral direction of the sound would be preferred. A drum radiates the majority of its sound in an axial direction from the head or heads both upwardly and downwardly. Consequently, the sound which is projected vertically is of little contribution to the sound of the band and several drums are generally employed to obtain the needed drum volume.

With this background in mind the present invention was conceived and one of its objectives is to provide a reflecting member which will more desirably direct a musical instrument's sounds.

It is yet another objective of the present invention to provide a reflector for a musical instrument which is simple to construct and inexpensive to produce.

It is yet another objective of the present invention to provide a reflector for a musical instrument which can be easily placed in position on the instrument and subsequently adjusted or removed with little difficulty.

It is still another objective of the present invention to provide a reflector for a musical instrument which has suitable adjusting means for adjusting the direction and sounds produced by the instrument.

It is another object of the present invention to direct a musical instrument's sounds radially from the musical instrument.

SUMMARY OF THE INVENTION AND DESCRIPTION OF THE DRAWINGS

The invention as presented herein includes a reflector or acoustic mirror mounted in the path of sound waves generated by a musical instrument. The sound waves generated by the instrument impinge the reflector and thus change directions due to their reflection. Various instruments can be adapted to utilize the reflector and only a few are shown herein. The reflector can have one of several physical embodiments, depending upon the particular use and tonal qualities desired by the musician.

Turning now to the drawings, FIG. 1 demonstrates a typical snare drum utilizing the present invention;

FIG. 2 illustrates one example of a concave embodiment for the reflector;

FIG. 3 demonstrates yet another concave embodiment of a reflector member;

FIG. 4 illustrates a planar reflector as employed in FIG. 1;

FIG. 5 demonstrates yet another embodiment of a concave reflector or acoustic mirror with a center opening;

FIG. 6 illustrates a convex reflector;

FIG. 7 demonstrates a typical horn employing a concave reflector;

FIG. 8 demonstrates yet another view of the concave reflector affixed to the horn's bell; and FIG. 9 shows an adjusting means as can be used with the present invention.

For a more detailed description of the invention, referring to FIG. 1, a typical drum 10 as would be used by a marching musician is shown with playing head 11, and with cylindrical sound chamber wall 12 which encloses sound chamber 13. Drum 10 is shown as a single headed drum although double headed drums may also be employed with the present invention. Mounted slightly below sound chamber 13 and spatially aligned therewith is planar acoustical mirror member 14 which will deflect sound waves emanating from head 11 in a radial or lateral direction as shown by arrows 15. The spatial alignment between the sound chamber 13 and the reflector 14 can be increased or decreased by turning the adjusting means 16 the desired amount. While no exact limitations are required for the adjusting means, for practical purposes an adjustment of several inches has been found to be satisfactory, depending upon the particular reflector embodiment employed.

In use, the drummer can adjust the reflector to have spatial alignment of approximately one inch between the sound chamber and the reflector. After playing the instrument, the drummer can then increase or decrease the spatial alignment by the adjusting means 16 as needed. As shown in FIG. 1, three adjusting means are employed for use with the drum though more or less may be found satisfactory.

FIG. 2 demonstrates another embodiment of a reflector member which provides a different tonal effect or reflection when used in place of the planar reflector or acoustic mirror of FIG. 1. As shown in FIG. 2, the sound waves are reflected more vertically as they approach the outer edge 18 of reflector member 17 as shown by arrows 19 and are more laterally reflected near the center 20 as shown by arrows 21.

In FIG. 3, another reflector member 22 is shown having a concave configuration. Typical sound waves 23 illustrate the lateral reflection by the acoustic mirror.

In FIG. 4, planar reflector member 14 is shown which may be constructed of treated natural products such as wood or metals or may be made of synthetic materials such as certain plastics or any combination thereof. As shown in this figure typical sound waves 24 are reflected laterally away from planar reflector 14.

A substantially concave reflector 25 is shown in FIG. 5 having an opening 26 at its center. As shown, sound wave 27 which would emanate, for example from the center of the drum head 31 would pass directly through the reflector and not be reflected. In contrast, sound wave 28 would be laterally reflected as it strikes reflector member 25.

In FIG. 6, a convex reflector 29 is shown with reflected sound waves 30 directed toward the center of drum head 31.

In FIG. 7, concave reflector member 32 is shown adjustably attached to bell 33 as would be used, for example, on an upright tube. Adjusting means 34 is used to regulate the distance between reflector 32 and bell 33.

Figure 9:
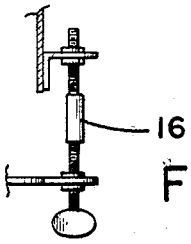
FIG. 9 shows a typical adjusting means as may be used with the present invention, though other constructions are available and may be employed.
Figure 1:
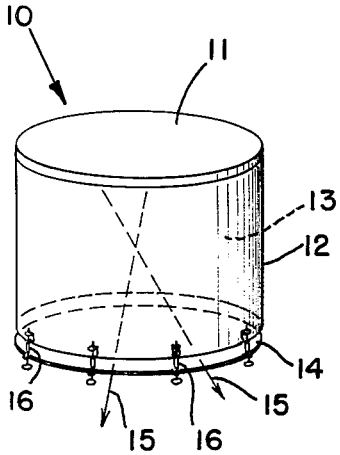
Figure 2:
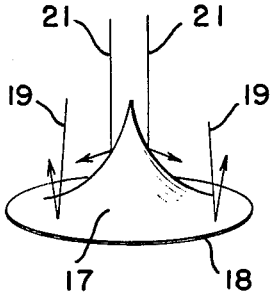
Figure 3:
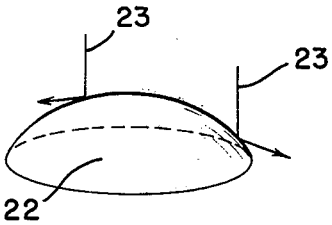
Figure 4:
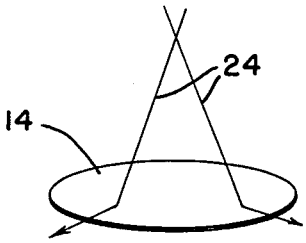
Figure 5:
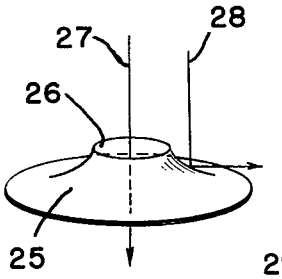
Figure 6:
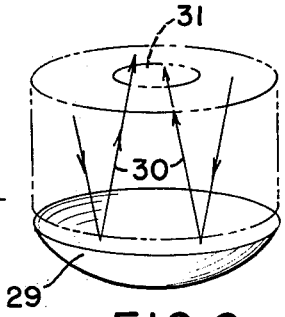
Figure 7:
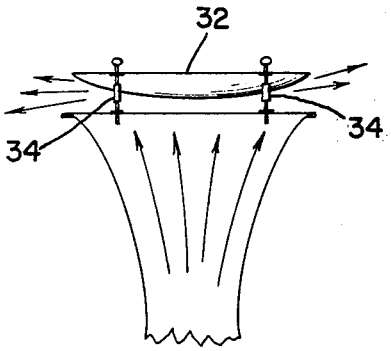
Figure 8:
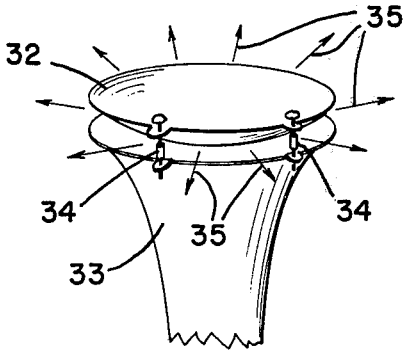
FIG. 8 is another illustration of the reflector 32 shown with the radial or lateral sound waves being directed as shown by the arrows 35.

Various modifications and changes may be made in the reflector as would be obvious to one skilled in the art and the illustrations shown herein are not for the purpose of limitation.

I claim:

1. A sound reflector and drum comprising a sound chamber and at least one sound generating head above said sound chamber, an acoustic mirror, said mirror being spatially aligned below said sound chamber and substantially outside thereof for receiving sounds generating by said head whereby said sounds received by said mirror will be reflected laterally, said mirror including a plurality of adjusting means for spatially aligning said mirror with said drum.

2. A sound reflector for a drum as claimed in claim 1 wherein said mirror is substantially planar.

3. A sound reflector for a drum as claimed in claim 1 wherein said mirror is substantially concave.

4. A sound reflector for a drum as claimed in claim 1 wherein said mirror is substantially convex.

5. A sound reflector for a drum as claimed in claim 1 wherein said mirror contains an opening therein.

* * * * *